US007017314B2

(12) United States Patent
Pace

(10) Patent No.: US 7,017,314 B2
(45) Date of Patent: Mar. 28, 2006

(54) APPARATUS AND METHOD FOR COMPOSITE CONCRETE AND STEEL FLOOR CONSTRUCTION

(76) Inventor: Malcolm J. Pace, 1925 S. Recker Rd., Mesa, AZ (US) 85206

( * ) Notice: Subject to any disclaimer, the term of this patent is extended or adjusted under 35 U.S.C. 154(b) by 573 days.

(21) Appl. No.: 10/198,018

(22) Filed: Jul. 17, 2002

(65) Prior Publication Data

US 2004/0010995 A1 Jan. 22, 2004

(51) Int. Cl.
*E04B 1/16* (2006.01)

(52) U.S. Cl. ..... 52/334; 52/338
(58) Field of Classification Search ..... 52/334, 52/335, 338, 414, 781.5
See application file for complete search history.

(56) References Cited

U.S. PATENT DOCUMENTS 3,269,071 A * 8/1966 Johnson ..... 52/338
3,362,121 A 1/1968 Weber
4,151,694 A * 5/1979 Sriberg et al. ..... 52/665
4,432,178 A * 2/1984 Taft ..... 52/334
4,454,695 A 6/1984 Person
4,592,184 A * 6/1986 Person et al. ..... 52/334
4,653,237 A * 3/1987 Taft ..... 52/335
4,660,341 A * 4/1987 Holtz ..... 52/326
4,700,519 A 10/1987 Person et al.
4,715,155 A 12/1987 Holtz
5,941,035 A * 8/1999 Purse ..... 52/263

* cited by examiner

*Primary Examiner*—Peter M. Cuomo
*Assistant Examiner*—Stephen Vu
(74) *Attorney, Agent, or Firm*—Wright Law Group, PLLC; Mark F. Wright

(57) ABSTRACT

A composite floor system comprises a system of joists, where each of the joists has a top chord, a bottom chord and a web, including tension and compression members in the space between the top chord and the bottom chord and secured to the top and bottom chords, and a top chord that is formed substantially in the shape of a cross.

13 Claims, 4 Drawing Sheets

APPARATUS AND METHOD FOR COMPOSITE CONCRETE AND STEEL FLOOR CONSTRUCTION

TECHNICAL FIELD

The present invention relates to the construction of buildings such as large open span buildings and more particularly relates to composite floor systems and a novel design for joists used in such a floor system and installation of such joists.

BACKGROUND OF THE INVENTION

Composite floor systems have been employed in multi-story building construction for many years and improvements are constantly being sought, both in the materials used in the composite floor systems and the methodologies used to erect the buildings that incorporate composite floor systems. The development and sophistication of these structural systems has gradually extended to encompass many varieties of steel and concrete floor construction, the result of which has been to measurably reduce the cost of steel framing for multi-story buildings in the industry.

In the past, concrete and steel floor construction methods have included open-web steel joists placed in position spanning structural supports with a concrete slab poured on decking supported by the joists. Generally, an open-web steel joist is a joist in the form of a truss having horizontal top and bottom chords joined by a web comprising tension and compression members triangulating the space between the top and bottom chords.

While the chords may be of many shapes, typically, the top and bottom chords each comprise a pair of steel angle bars, the top chord angle bars being arranged with one leg of each bar extending horizontally outward at the top of the truss, and the other leg of each bar extending downwardly on opposite sides of the web. The bottom chord angle bars are arranged with one leg of each bottom chord angle bar extending horizontally laterally outward at the bottom of the truss, and the other leg of each bottom chord angle bar extending vertically upward on the opposite sides of the web. Decking for supporting the concrete slab is laid on and fastened to the horizontal leg of the top chord angle bars at the top of the joist, and a concrete slab is the poured on the decking. In this typical construction, there is no structural integration of the concrete slab to the joists, and the slab and joists function as separate entities with the slab constituting dead load on the joists without contributing materially to the strength of the overall structure.

In another construction method, the upper ends of the web members project upwardly above the upper horizontal legs of the top chord angle bar for anchorage in the concrete slab to form a composite slab and joist construction in which the slab may, to some extent, become a compression member sharing part of the load. It has been found that this type of construction does not obtain the full potential of a composite slab joist construction, and has certain disadvantages. For example, the effective anchorage is between the slab and the upper ends of the web members so that transfer of stress between the joists and the slab occurs only at the upper ends of the web members. Furthermore, the slab is necessarily placed above the level of the supporting structure for the joists. In addition, the decking is formed with slots to enable the web member to protrude into the concrete forming the composite section. This creates another problem, namely, that the slots must be exactly aligned along the length of the building and the joist must also be perfectly aligned.

Yet another construction method employs an open-web steel joist in the form of a truss having a web, a top chord and a bottom chord. The top chord comprises a pair of steel angle bars arranged with one leg of each of the angles extending horizontally outward from a position on the truss below the top of the truss, and the other leg of each angle extending upwardly to the same height on opposite sides of the web and terminating below the top of the web. Decking is laid on the horizontal legs of the top chord, and concrete is poured on the decking to embed the vertical legs of the top chord angle bars and the upper ends of the web in the concrete slab to create a composite floor structure. In this construction, the top chord is below the top of the web member and composite action is obtained primarily by embedding the portion of the web extending above the top of the top chord into the concrete slab.

It will be appreciated that the purposes of composite floor construction are to save considerable steel weight and cost, as well as to reduce depth and deflection. While many of these various methods for forming composite floor systems have enjoyed some commercial success in achieving the stated goals, there is a continual search for even more effective and efficient methods for constructing these composite floor systems.

In view of the foregoing, it should be appreciated that it would be desirable to provide additional methodologies for constructing various types of composite floor systems that are simpler and less expensive to install, using existing materials and components to the extent possible.

SUMMARY OF THE INVENTION

The composite floor system of the present invention comprises a system of joists, where each of the joists has a top chord, a bottom chord and a web, including tension and compression members in the space between the top chord and the bottom chord and secured to the top and bottom chords, and a top chord that is formed substantially in the shape of a cross.

BRIEF DESCRIPTION OF THE DRAWINGS

The present invention will hereinafter be described in conjunction with the appended drawing figures, wherein like numerals denote like elements, and.

FIG. **4*a* is a perspective view of the top chord of a joist in accordance with an alternative preferred embodiment of the present invention.

DETAILED DESCRIPTION OF THE DRAWINGS

The present invention relates to a composite floor system and parts and formwork therefore and erecting method for use in the construction of buildings such as large open span commercial or residential buildings. The present invention is particularly concerned with composite floor systems made from steel and concrete using joists with a novel top chord member.

Figure 1:
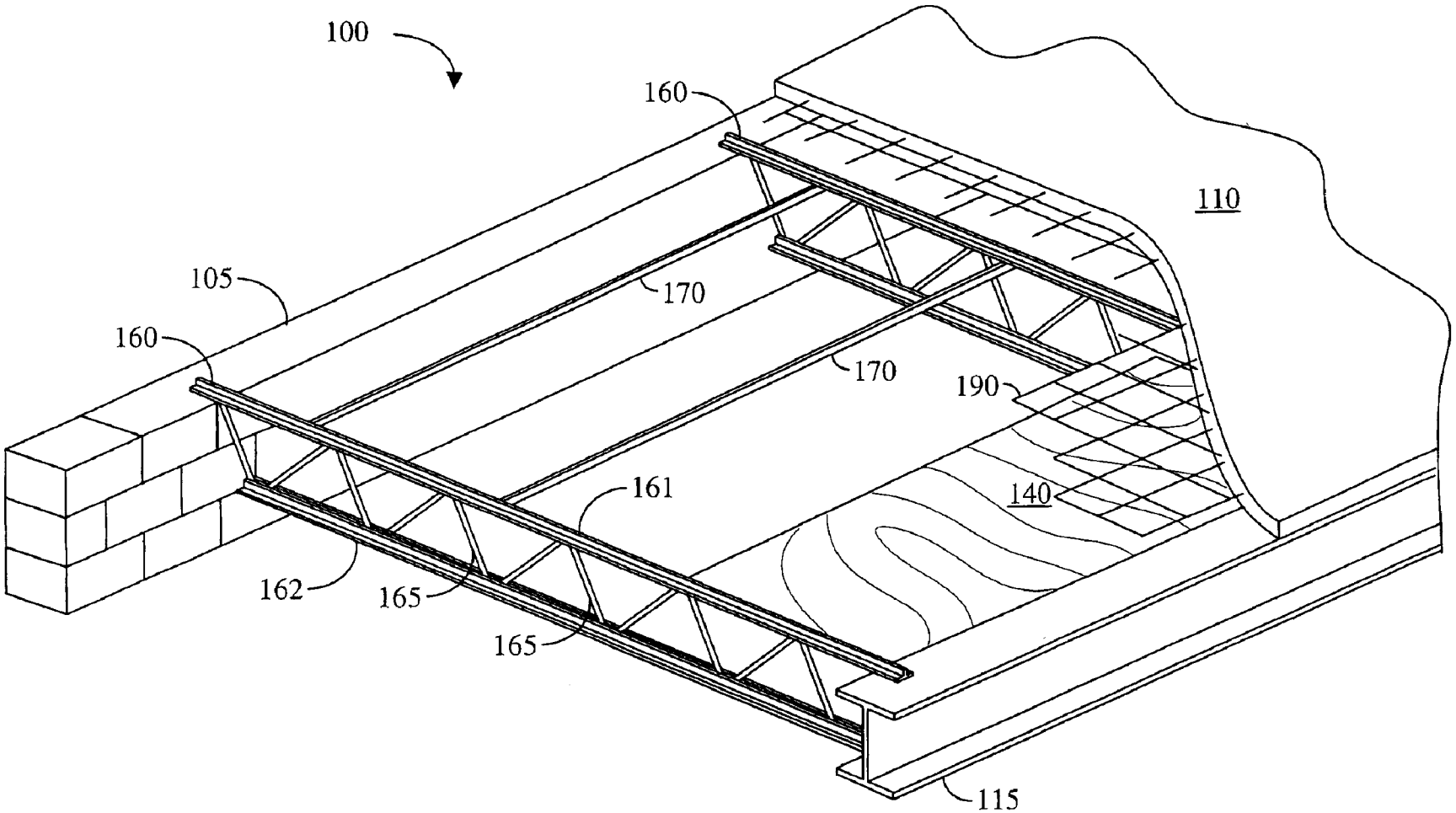
FIG. 1 is a partial perspective cut-away view of a composite floor system in accordance with a preferred embodiment of the present invention.

Referring now to FIG. 1, a partial cut-away view of a composite floor system 100 in accordance with a preferred embodiment of the present invention is shown. Composite floor system 100 comprises: a first support structure 105; a second support structure 115; a plurality of joists 160 suspended and extending between support structures 105 and 115; a plurality of removable spanner bars 170 selectively inserted into slots formed in the body of joists 160; a support platform 140 placed over and resting on spanner bars 170; a concrete slab 110 poured in place and supported by support platform 140; and a reinforcing material 190 embedded in concrete slab 110. In the most preferred embodiments of the present invention, joists 160 may also comprise a series of concrete-engaging mechanisms to further connect slab 110 with the supporting structure formed by joists 160.

Each joist 160 comprises a top chord 161, a bottom chord 162 and an intermediate connecting web member 165. Each top chord 161 and bottom chord 162 is most preferably affixed to connecting web members 165 by welding or some other suitable method. Each top chord 161 defines a cross section that is substantially cross-shaped along the longitudinal axis of each joist 160. Intermediate connecting web member 165 may be a single connecting member or may be multiple discrete connecting members. Further details about joists 160 are presented in conjunction with FIGS. 4, 4A, and 5.

While support structures 105 and 115 are depicted as a block wall and an I-beam respectively, it should be understood that these are merely representative of the types of support structures that may be utilized in conjunction with the present invention. In practice, support structures 105 and 115 may be any type of structure capable of supporting the load of composite floor system 100, including columns, load-bearing interior walls, etc.

Once joists 160 are in place, removable spanner bars 170 are inserted into the lower portion of joists 160 by inserting the ends of spanner bars 170 into a series of apertures formed in the lower portion of the top chord of joists 160. The location and number of removable spanner bars 170 used for supporting a given concrete slab 110 can be determined by performing load analysis calculations for composite floor system 100.

With the appropriate number of removable spanner bars 170 in place, support platform 140 can be installed. Support platform 140 rests on and is supported by removable spanner bars 170. Support platform 140 provides a form for defining the bottom of concrete slab 110 and also provides stability to the overall structure prior to the pouring of concrete slab 110.

After support platform 140 has been completed, reinforcing material 190 is placed over the top of joists 160. Reinforcing material 190 is typically a welded wire mesh and is provided to add additional strength and stability to concrete slab 110 and will be embedded within concrete slab 110. Finally, concrete slab 110 can be poured in place over support platform 140 and reinforcing material 190. Support platform 140, in concert with joists 160, removable spanner bars 170 and support structures 105 and 115, support concrete slab 110 while it hardens and cures. After an appropriate period of time, such as approximately one or two days, spanner bars 170 and support platform 140 can be stripped from joists 160. Concrete slab 110 may be further reinforced in the usual way to carry any loads between any vertical parallel walls and joists 160.

It should be noted that, after positioning joists 160 as shown in FIG. 1, the bottom portion of each top chord of each joist 160 is resting on the top edge of support structures 105 and 115. However, a vertical leg portion of each top chord of each joist 160 protrudes above the top edge of support structures 105 and 115 and becomes embedded in concrete slab 110.

Figure 2:
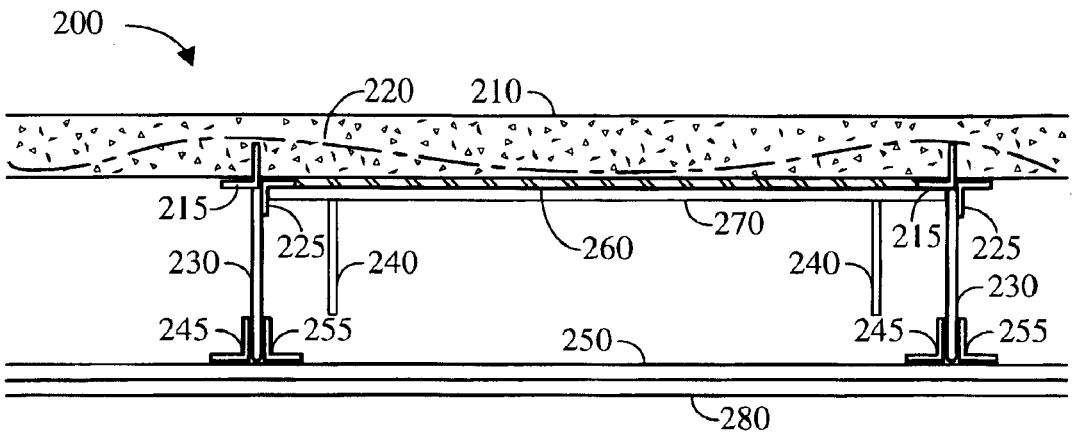
FIG. 2 is a vertical section view of a composite floor system in accordance with a preferred embodiment of the present invention.

Referring now to FIG. 2, a sectional view of a composite floor system 200 in accordance with a preferred embodiment of the present invention is shown. Composite floor system 200 comprises a concrete slab 210, a plurality of joists 230, a reinforcing material 220, a plurality of spanner bars 270, a plurality of handles 240 attached to spanner bars 270, a support platform 260, a hat channel 250; and a ceiling 280.

In the most preferred embodiments of the present invention, each joist 230 comprises a top chord fashioned from two discrete components, a first upper angle 215 and a second upper angle 225. In the most preferred embodiments of the present invention, first upper angle 215 and a second upper angle 225 are typically joined together by conventional welding methods and techniques, such as a fillet weld along their common longitudinal edges. It should be noted that in another preferred embodiment of the present invention, first upper angle 215 and second upper angle 225 may be an integral member, formed via extrusion or some other suitable process. In either case, first upper angle 215 has an upward vertical component that is embedded in concrete slab 210 and second upper angle 225 has a downward vertical component that is fixedly attached to the central open web portion of each joist 230. Additionally, each joist 230 has a first lower angle 245 and a second lower angle 255. First lower angle 245 and second lower angle 255 are affixed to opposite sides of the central open web portion of each joist 230 and each further comprises an upward vertical component and a horizontal component.

Reinforcing material 220 is a welded wire fabric or rebar mat placed over the upward vertical component of each first upper angle 215 of each joist 230, prior to the pouring of concrete slab 210. In the most preferred embodiments of the present invention, reinforcing material 220 is a welded wire fabric with a mesh-like appearance. However, it should be noted that any other reinforcing material capable of developing the required structural capacity may be used as well. Reinforcing material 220 is typically draped over the upper chords of joists 230 and hangs in a catenary-like shape between the joists to provide the most effective reinforcement. Reinforcing material 220 is completely encased with the boundaries of concrete slab 210.

Support platform 260 is suspended on spanner bars 270 prior to the pouring of concrete slab 210. Support platform 260 is used as a form for defining the bottom surface of concrete slab 210. Support platform 260 also provides a degree of lateral stability to the structure of composite floor system before concrete slab 210 is poured. After concrete slab 210 has been poured and allowed to cure for an appropriate amount of time, spanner bars 270 are removed by using handles 240 and support platform 260 may be stripped from concrete slab 210 and may then be reused in subsequent concrete pouring operations. Hat channel 250 is attached to joists 230 and ceiling 280 is attached to hat channel 250.

With the composite floor system of the present invention, it is possible to utilize standard-sized materials to form the support structure for the concrete slab. For example, the spacing of joists 230 may be advantageously fixed at approximately four-foot centers, thereby enabling the use of readily available and inexpensive standard 4' by 8' sheets of plywood for support platform 260. It should also be recognized that, in accordance with contemporary construction practice, such plywood panels would be treated with a release coating, such as oil, to avoid adherence of concrete slab 210 to plywood used in support platform 260. Such a release coating enables the ready stripping of support platform 260 beneath concrete slab 210 with a minimum loss of formwork due to accidental destruction. Alternatively, support platform 260 may be constructed from typical steel pan formwork or some other material known to those skilled in the art that provides sufficient strength to support concrete slab 210.

Figure 3:
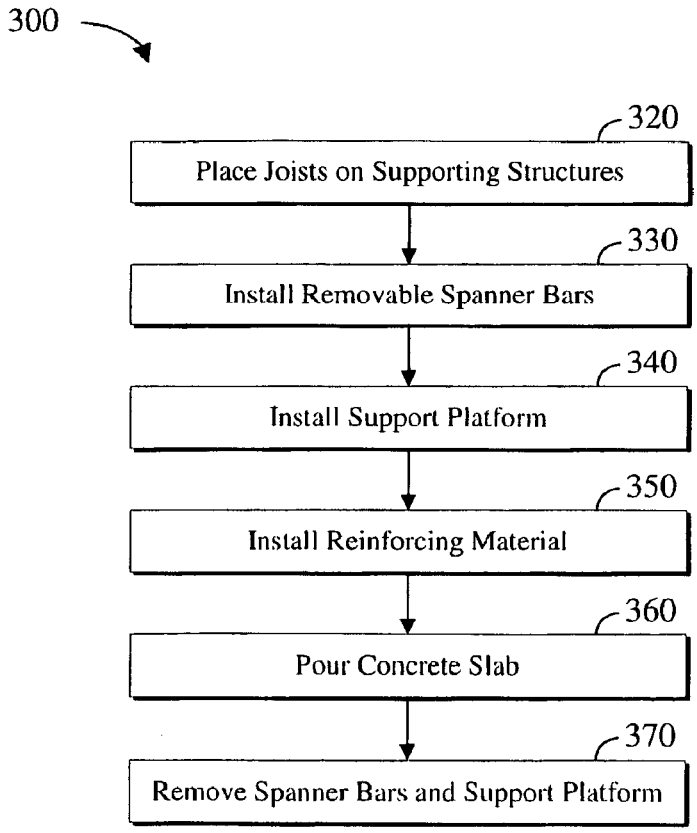
FIG. 3 is a flowchart depicting a method of constructing a composite floor system in accordance with a preferred embodiment of the present invention.

Referring now to FIG. 3, a flowchart depicting a method 300 of constructing a composite floor system in accordance with a preferred embodiment of the present invention is shown. First, the joists are positioned on the supporting structures by placing the joists on top of the supporting structures (step 320).

Next, a plurality of removable spanner bars are positioned between each pair of joists (step 330). Then, the support platform for the concrete slab is positioned on top of the removable spanner bars (step 340). As previously mentioned, the support platform may be any material capable of supporting the load of the concrete slab. After the support platform is in place, the reinforcing material is positioned by draping it over the upper chords of each of the joists (step 350). The reinforcing material is typically a welded wire mesh material well known to those skilled in the art. Once the reinforcing material has been positioned, the concrete slab can be poured over the support platform and allowed to cure (step 360). Finally, after the concrete slab has been allowed to sufficiently cure, the removable spanner bars and the support platform can be stripped from the underside of the concrete slab (step 370).

Figure 4:
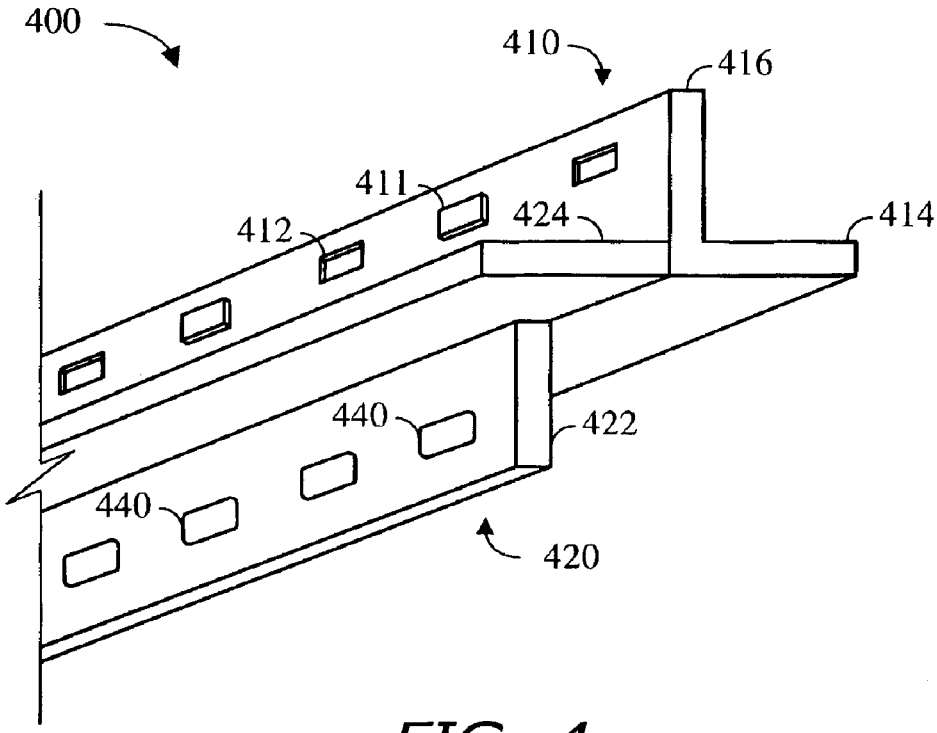
FIG. 4 is a perspective view of the top chord of joist in accordance with a preferred embodiment of the present invention.

Referring now to FIG. 4, an upper chord 400 of a joist used in constructing a composite floor system in accordance with a preferred embodiment of the present invention is shown. Upper chord 400 comprises a first upper angle 410 and a second upper angle 420. Each of first upper angle 410 and a second upper angle 420 has a cross section that forms approximately a 90° angle. First upper angle 410 comprises an upward vertical leg portion 416 and a horizontal leg portion 414. Second upper angle 420 comprises a downward vertical leg portion 422 and a horizontal leg portion 424. Horizontal leg portions 414 and 424 are located in substantially the same horizontal plane. In this specific embodiment, upward vertical leg portion 416 and downward vertical leg portion 422 are not co-planar but are slightly offset and are contained within substantially parallel planes. First upper angle 410 and second upper angle 420 may be joined by any suitable method, such as welding.

Apertures 440 are formed in downward vertical leg portion 422 and are sized and positioned to receive the end portions of removable spanner bars, such as those depicted in FIG. 2. As shown in FIG. 4, a section of downward vertical leg portion 422 has been removed, thereby allowing horizontal leg portions 414 and 424 to rest flat on top of a load-bearing structure for support of the joist to which top chord 400 is attached. In typical applications, downward vertical leg portion 422 will extend to some point within the space defined by the load-bearing structures while horizontal leg portions 414 and 424 will extend over the top of the load-bearing structures to the approximate mid-point of the load-bearing structures, as shown in FIG. 1.

Additionally, optional concrete-engaging mechanisms 411 and 412 are shown along the lateral portion of upward vertical leg portion 416. In the most preferred embodiments of the present invention, concrete-engaging mechanism 411 is a raised portion of first upper angle 410 and concrete-engaging mechanism 412 is a recessed portion of first upper angle 410. While shown as generally rectangular in shape, concrete-engaging mechanisms 411 and 412 may take on any suitable shape, including arcuate projections such as dimples and/or indentations.

Additionally, concrete-engaging mechanisms 411 and 412 may be apertures formed in the lateral portion of upper chord 400. Concrete-engaging mechanisms 411 and 412 are provided to aid in the composite action of the joist employing upper chord 400. Along with upward vertical leg portion 416, concrete-engaging mechanisms 411 and 412 are most preferably embedded in the concrete slab during the pouring process. While not shown, additional concrete-engaging mechanism may be formed in horizontal leg portions 414 and 424 to increase the concrete-engaging ability of the composite structure.

Figure 4A:
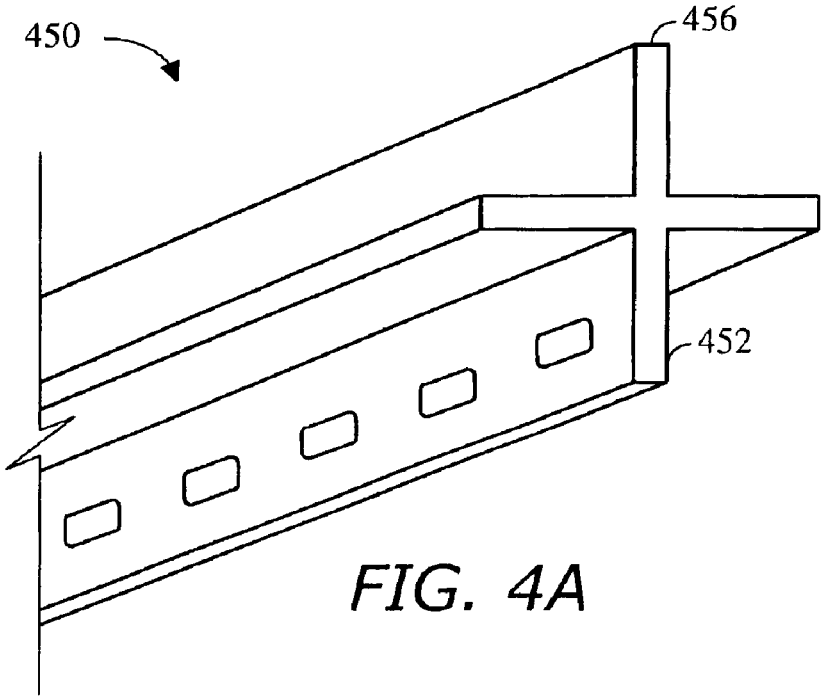

Referring now to FIG. 4A, a joist 450 used in constructing a composite floor system in accordance with an alternative preferred embodiment of the present invention is shown. In this specific embodiment, joist 450 is a unitary member and may be formed by extrusion or other similar process. Additionally, joist 450 may include concrete-engaging mechanisms as shown in FIG. 4. However, in contrast to FIG. 4, upward vertical leg portion 456 and downward vertical leg portion 452 are substantially co-planar.

Figure 5:
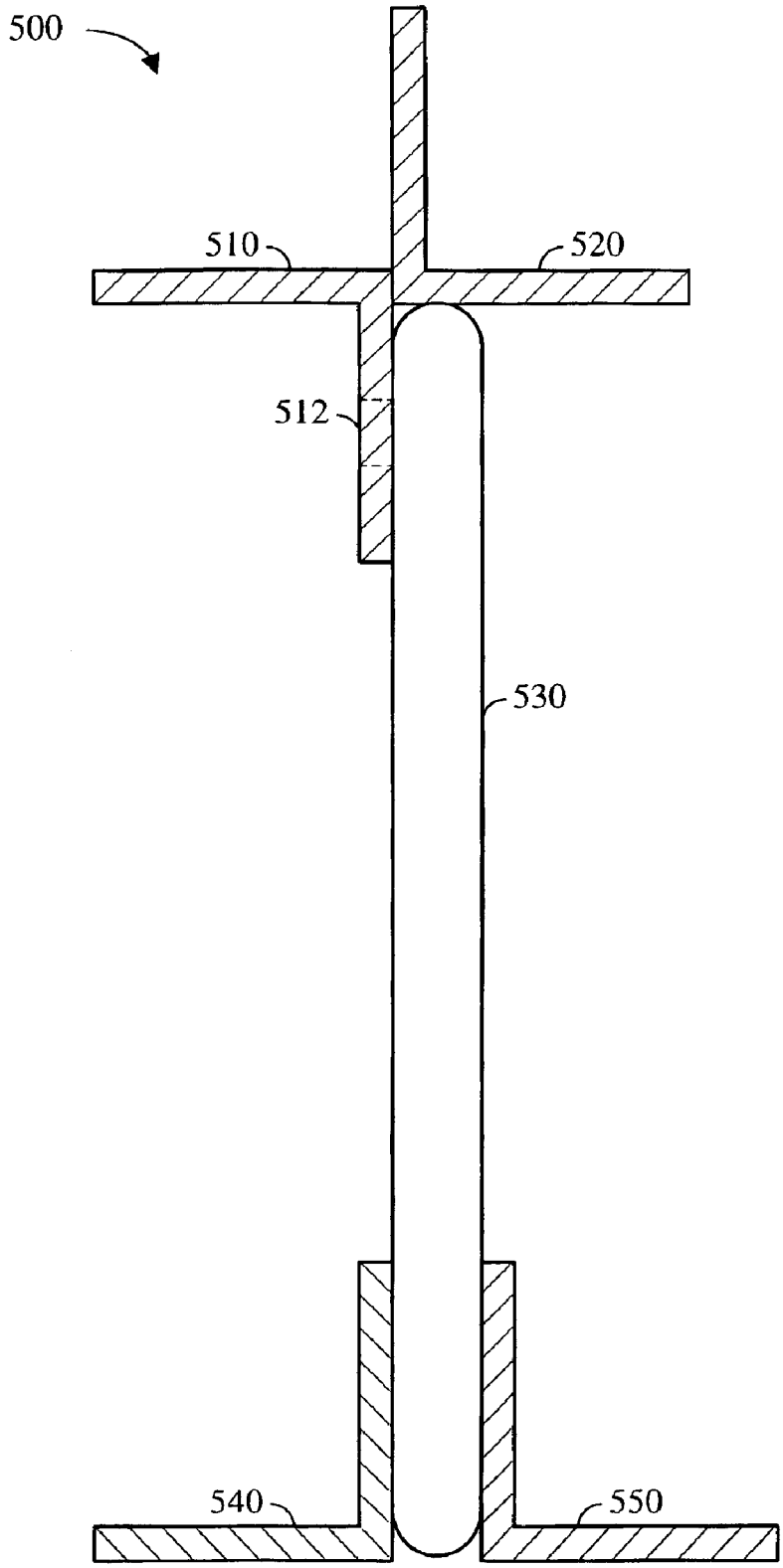
FIG. 5** is a side cutaway view of a joist in accordance with a preferred embodiment of the present invention.

Referring now to FIG. 5, a side view of a joist 500 used in constructing a composite floor system in accordance with a preferred exemplary embodiment of the present invention is shown. Joist 500 comprises an intermediate web portion 530 extending between upper angles 510 and 520 and lower angles 540 and 550. Upper angles 510 and 520 may be fastened together by welding or any other suitable method. Intermediate web portion 530 may be fastened to upper angles 510 and 520 and lower angles 540 and 550 by welding or any other suitable method. Aperture 512 is formed in the downward vertical portion of upper angle 512 and is sized and positioned to receive the end of a removable spanner bar.

While certain preferred exemplary embodiments have been presented in the foregoing detailed description, it should be appreciated that a vast number of variations exist. It should also be appreciated that these preferred embodiments are only examples and are not intended to limit the scope, applicability, or configuration of the invention in any way. Rather, the foregoing detailed description provides those skilled in the art with a convenient roadmap for implementing the preferred exemplary embodiments of the invention. It should be understood that various changes may be made in the function and arrangement of elements described in the exemplary preferred embodiments without departing from the spirit and scope of the invention as set forth in the appended claims.

What is claimed is:

1. A composite steel and concrete floor construction comprising:

a concrete slab;

a plurality of individual laterally placed, parallel disposed, and supported joists, wherein each of said plurality of joists comprises an upper chord and a lower chord, said upper chord of at least one of said plurality of joists comprising a substantially cross-shaped cross section about a longitudinal axis;

an intermediate web member joining said upper chord and said lower chord, said intermediate web member comprising a plurality of tension and compression members triangulating a space between said upper chord and said lower chord;

wherein each of said upper chords of each of said plurality of joists comprises:

a first angle, said first angle comprising a first horizontal leg portion and an upward vertical leg portion; and a second angle, said second angle comprising a second horizontal leg portion and a downward vertical leg portion; and wherein at least a portion of each of said upward vertical leg portions of each of said first angles of each of said plurality of joists is embedded in said concrete slab; and a reinforcing mesh at least partially supported upon said upper chords of said plurality of joists and hanging generally in a catenary shape therebetween and being fully embedded in said slab.

2. The composite steel and concrete floor construction of claim 1 wherein each of said first horizontal leg portions of each of said first angles of each of said plurality of joists comprises a plurality of concrete-engaging mechanisms.

3. The composite steel and concrete floor construction of claim 2 wherein said plurality of concrete-engaging mechanisms comprises a plurality of projections.

4. The composite steel and concrete floor construction of claim 2 wherein said plurality of concrete-engaging mechanisms comprises a plurality of raised portions and recessed portions.

5. The composite steel and concrete floor construction of claim 1 further comprising a plurality of support structures supporting each of said plurality of joists.

6. A method comprising the steps of:

supporting a plurality of joists between a plurality of support structures, each of said plurality of joists comprising:

an upper chord, said upper chord comprising a substantially cross-shaped cross section about a longitudinal axis, said upper chord comprising:

a first angle, said first angle comprising a first horizontal leg portion and a upward vertical leg portion; and a second angle, said second angle comprising a second horizontal leg portion and a downward vertical leg portion;

a lower chord;

an intermediate web member joining said upper chord and said lower chord, said intermediate web member comprising a plurality of tension and compression members triangulating a space between said upper chord and said lower chord;

placing a plurality of removable spanner bars extending between said plurality of joists;

placing a support platform over said plurality of removable spanner bars; and pouring a concrete slab over said support platform, thereby embedding at least a portion of at least one vertical leg portion of at least one of said plurality of joists in said concrete slab.

7. The method of claim 6 further comprising the steps of:

waiting for said concrete slab to cure;

removing said plurality of removable spanner bars; and removing said support platform.

8. The method of claim 6 wherein said support platform comprises a plurality of plywood sheets.

9. The method of claim 6 further comprising the step of suspending a reinforcing mesh at least partially upon said upper chords of said plurality of joists prior to pouring said concrete slab, said reinforcing mesh hanging generally in a catenary shape therebetween and being fully embedded in said concrete slab.

10. The method of claim 6 wherein said upward vertical leg portion comprises a plurality of concrete-engaging mechanisms.

11. The method of claim 10 further comprising the step of engaging at least a portion of said concrete slab with said plurality of concrete-engaging mechanisms.

12. The method of claim 6 wherein at least one of said first horizontal leg portion and said second horizontal leg portion comprise a plurality of concrete-engaging mechanisms.

13. The method of claim 12 further comprising the step of engaging at least a portion of said concrete slab with said plurality of concrete-engaging mechanisms.

* * * * *